United States Patent [19]

Wildey

[11] Patent Number: 4,474,335

[45] Date of Patent: Oct. 2, 1984

[54] APPARATUS FOR CENTRIFUGAL PULPWOOD AND WOOD CHIP GRINDING

[75] Inventor: Allan J. Wildey, Brantford, Canada

[73] Assignee: Koehring Canada, Brantford, Canada

[21] Appl. No.: 383,713

[22] Filed: Jun. 1, 1982

[30] Foreign Application Priority Data

Dec. 7, 1981 [GB] United Kingdom ..... 8136864

[51] Int. Cl.[3] ..... B02C 19/12

[52] U.S. Cl. ..... 241/41; 241/28; 241/60; 241/242; 241/275

[58] Field of Search ..... 241/21, 28, 41, 152 A, 241/107, 228, 275, 274, 276, 299, 89.3, 95, 278 A, 60, 242, 186 R

[56] References Cited

U.S. PATENT DOCUMENTS

| | | | |
|---|---|---|---|
| Re. 13,820 | 11/1912 | Kinsey | 241/186 R X |
| 143,940 | 10/1873 | Sturdevant | 241/28 |
| 3,754,715 | 8/1973 | Udy | 241/275 X |
| 4,270,703 | 6/1981 | Haikkala | 241/28 X |
| 4,274,600 | 6/1981 | Haikkala | 241/28 X |
| 4,394,977 | 7/1983 | Mijala | 241/28 X |

FOREIGN PATENT DOCUMENTS

| | | |
|---|---|---|
| 2834 | 10/1873 | Canada . |
| 1097118 | 3/1981 | Canada . |

*Primary Examiner*—Mark Rosenbaum
*Attorney, Agent, or Firm*—Sim & McBurney

[57] ABSTRACT

There is provided a centrifugal grinder which utilizes an internal grinding surface in the shape of a surface of revolution. A rotor is mounted coaxially within the grinding surface and has a central cavity defining at least one pocket through which material in the central cavity can contact the grinding surface. Material for grinding is delivered to the central cavity, and means are provided for rotating the rotor. Further means are incorporated in the rotor for applying water to the grinding surface.

10 Claims, 7 Drawing Figures

APPARATUS FOR CENTRIFUGAL PULPWOOD AND WOOD CHIP GRINDING

The present invention relates to a method and apparatus for grinding pulpwood and/or wood chips, in which the force urging the wood against the grinding surface arises centrifugally. The present method and apparatus also includes various other features and advantages, which will be dealt with in detail below.

GENERAL BACKGROUND OF THIS INVENTION

One conventional method of producing ground wood pulp for the manufacture of paper products involves pressing a batch of pulpwood (roundwood or wood chips) against a rotating grinding stone while simultaneously feeding shower water into the grinding chamber, specifically by spraying the water directly on the surface of the stone at a location spaced from the actual grinding location. By means of a dam or weir, the formed ground wood stock, which is an aqueous slurry of pulp, is kept in the grinding chamber at a level a little higher than the lower point of the stone in order to clean, lubricate and cool the stone. The ground wood stock flowing over the dam is discharged by its own weight for further treatment. A variant of the foregoing is the "pitless" method, in which the stone is not immersed, and provision is made for extra water showers.

Another known method utilizes a disc refiner, in which material being refined or reduced is worked between two closely spaced opposed discs which undergo relative rotation.

In a recent development, the wood is ground under superatmospheric pressure, thus permitting grinding temperatures higher than in the standard stone groundwood (SGW) In U.S. Pat. Nos. 3,808,090 and 3,948,449, a process is described for improving the groundwood pulp by grinding wood in a closed grinding chamber in a pressurized gaseous atmosphere. In the two patents just named, the wood is fed in and the superatmospheric pressure in the grinding chamber can be maintained only so long as the grinding of a wood batch continues. However, when a new wood batch must be fed into the magazine, the magazine must be opened and the pressure of the grinding surface falls to atmospheric. Thus, the grinder does not work in a continuously pressurized atmosphere.

In an attempt to overcome the problem just defined, additional developments have been made and patented by Oy Tampella Ab, as exemplified in Canadian Patent No. 1,097,118 issued Mar. 10, 1981, and U.S Pat. Nos. 4,270,703 and 4,274,600 issued June 2, 1981 and June 23, 1981, respectively. In the Oy Tampella process, a feed chamber upstream of the grinding chamber has two pressure seals, one to the atmosphere and one to the grinding chamber. Thus, the feed chamber acts as a double-lock seal, to allow the pressure in the grinding chamber always to be maintained above atmospheric. By the use of this method, the pressure in the grinding chamber may reach as high as several bar, and temperatures at the grinding stone surface may climb well above the standard pressure boiling point.

Because of the considerable size and complexity of the SGW process and the pressurized groundwood (PGW) process developed hitherto, it would be desirable to reduce the complexity and size of an installation for producing ground pulp that can be used in paper making. In both the PGW and SGW processes, very large pressure shoes must be hydraulically driven to urge the roundwood against the grinding stone, and above the general location of the pressure shoes must be provided a stack for the incoming wood to be ground.

A different approach to the grinding of wood pulp is one in which the grinding pressure between the wood and the grinding surface is brought about centrifugally, by providing an internal cylindrical grinding surface, and by "flinging" the wood outwardly against the stationary grinding surface through the use of centrifugal force. The centrifuging action not only would allow the appropriate pressure to arise between the wood and the grinding surface, but could also pressurize a quantity of water being swept around along with the wood, thus permitting higher temperatures than the maximum attainable in the standard SGW process.

Early Canadian Patent No. 2834, issued Oct. 24, 1873 discloses a primitive version of a centrifugal grinder for wood, which incorporates a stationary internal cylindrical grinding surface, and a rotor turning about a vertical axis, and flinging the feed wood centrifugally outward along radial pathways to contact the grinding surface. Water for cooling the grinding surface and for making up the pulp slurry is simply squirted into the housing by a single hose or pipe.

Because of the primitive construction utilized by Moore, his apparatus would not do for the high speed grinding requirements of the present day.

Accordingly, it is an aspect of this invention to provide an apparatus that is improved with respect to the Moore apparatus, and in particular which utilizes the rotating principle in order to promote uniform and pressurized water spray against the internal grinding surface.

"Accordingly, this invention provides a centrifugal grinder which has an internal grinding surface in the shape of a surface of revolution. A rotor is mounted for rotation coaxially with the grinding surface, and has a central cavity defining at least two pockets through which material in the central cavity can contact the grinding surface. The pockets are uniformly distributed around the rotor and are separated by intermediate regions. Material is delivered to the central cavity and the rotor is rotated. Means are incorporated in the rotor for applying water to the grinding surface, the latter means including a first water pathway into the rotor adjacent the axis thereof, and for each pocket a second water pathway in the rotor adjacent the grinding surface and trailing the respective pocket in the sense of rotation. Water passage means joins the first pathway to each second pathway, and nozzle means communicates with each second pathway for spraying water against the grinding surface. Each second pathway is further than the first pathway from the rotor axis, so that rotation of the rotor increases the water pressure in the nozzle means with respect to that in the first pathway, due to the centrifugal effect.

This invention further provides a method of grinding a wood material against an internal grinding surface in the shape of a surface of revolution. The method includes a first step of rotating the material around the internal grinding surface in a plurality of discrete and circumferentially separated pockets to generate centrifugal grinding force between the material and the surface. The grinding surface is sprayed with water from nozzle means adjacently behind each pocket in the sense of rotation, in order to remove wood fibers therefrom and create a slurry. The centrifugal effect is utilized to increase water pressure at the nozzle means."

GENERAL DESCRIPTION OF THE DRAWINGS

Two embodiments of this invention are illustrated in the accompanying drawings, in which like numerals denote like parts throughout the several views and in which.

DETAILED DESCRIPTION OF THE DRAWINGS

Figure 1:
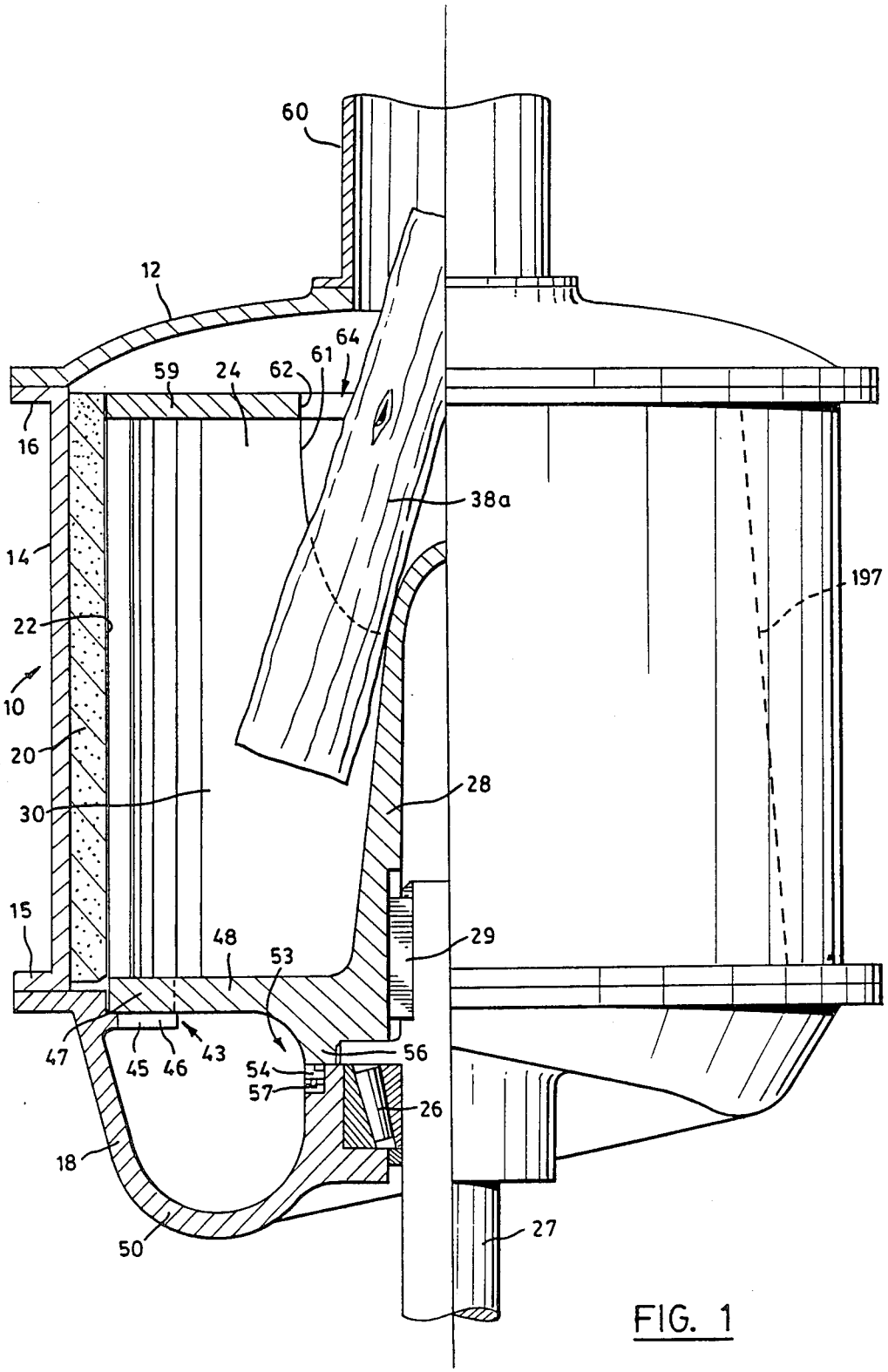
FIG. 1 is a part elevation and part sectional view of the first embodiment of a centrifugal pulp wood grinder constructed in accordance with this invention.

Attention is first directed to FIG. 1, of which the left hand portion is an axial sectional view of a centrifugal pulpwood grinder 10 which includes a cap-like top frame 12, a cylindrical outer stone mounting frame 14 having two outwardly extending flanges 15 and 16 at its opposite ends, and a bottom frame 18 which will be described in greater detail below. Securely mounted within the stone mounting frame are a plurality of stone segments 20 which provide a radially symmetrical, concave, cylindrical, inside grinding surface 22. The stone segments may be of hexagonal shape.

Mounted centrally of the grinding chamber 24 on conical bearings of which one is shown in FIG. 1 at the numeral 26 is a drive shaft 27, to which a rotary hub 28 is affixed by means of a key 29.

Extending substantially radially away from the hub 28 is at least one, and a preferably two or three hollow arms 30 adapted to propel the pulpwood circumferentially along and around the grinding surface 22.

Figure 2:
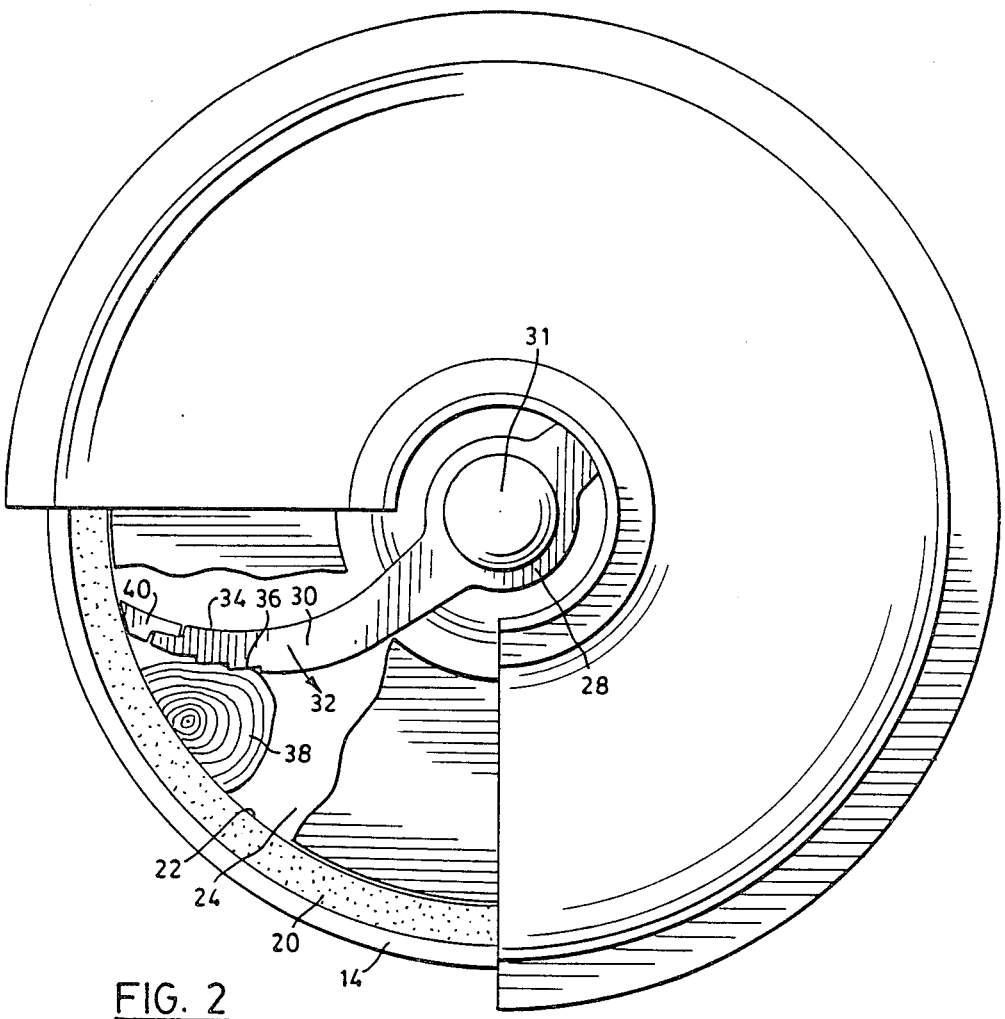
FIG. 2 is a part plan view and part horizontal sectional view of the centrifugal pulpwood grinder of FIG. 1.

As pictured in FIG. 2, the arm 30 rotates about the axis 31 in the direction of the arrow 32, and undergoes a gradual curvature so that its distal portion 34 slopes toward the rear compared to the direction of rotation. As can also be seen in FIG. 2, the distal portion 34 has a plurality of engagement teeth 36 along its forward surface, the teeth 36 being adapted to engage a piece of pulpwood 38 in order to stabilize the same as it rotates against the grinding surface 22, and in order to minimize bounce or rolling of the pulpwood 38. The hollow arm has, at its distal end, an adjustable finger bar 40, which may be a stainless steel casting, which is adapted to ride in close proximaty to the grinding surface 22 to ensure that the slurry of water and ground pulp in the vicinity of the pulpwood 38 will also be swept circumferentially around the grinding surface 22, and thus "flung" outwardly against the grinding surface 22 by reason of the centrifugal force.

It will be appreciated that, where only a single arm 30 is provided, the hub 28 will need to be counter-balanced by additional weight opposite the position of the single arm. By providing two opposed arms, or three identical arms at spacings of 120°, the need for counter-balance is eliminated.

Returning to FIG. 1, it will be seen that the bottom frame 18 includes a shredder shown generally by the numeral 43, the shredder 42 including a stator 45 and rotor 47, the rotor being an integral part of a disk-like rotating bottom wall 48 which is integral with the hub 28. The rotor 47 is provided with a plurality of slots, as is also the stator 45, and the openings 46 of the two sets of slots pass across each other at high speeds, thus shredding the ground pulp material through a type of scissors or shearing action. The purpose of the shredding is to break up slivers which would otherwise tend to propagate a downstream jamming condition.

The bottom frame 18 includes a wall 50 defining a volute constituted an evacuation zone for the pulp slurry. An opening (not shown) is provided for removing the pulp slurry from the evacuation zone. A bearing seal is shown generally by the numeral 53, and includes a stationary ring 54 of L-shape, which is urged upwardly against the bottom of an annular downward projection 56 integral with the hub 28 by a spring 57.

At the top of the hollow arm 30 is an annular plate 59 which, along with the portion 48, defines a containment zone for the aqueous pulp slurry which results from the grinding process.

Connected above the top frame 12 is a pulpwood feed pipe 60 along which pieces of pulpwood **38*a* can travel. It will be noted in FIG. 1 that the arm 30, while connected to the hub 28, also has a free inner edge 61 which terminates at the inner circumference 62 of the annular plate 59. Thus, there is defined a central opening 64 into which the pieces of pulpwood 38*a*** can fall.

It is contemplated that the hub 28 may not require the length shown in FIG. 1, and may terminate at a location closer to the key 29. It is also contemplated that the entire grinding chamber 24 could be additionally pressurized above atmospheric by the use of single or double seals (not shown), so that the pressure undergone by the aqueous slurry being centrifuged around and against the grinding surface 22 would be greater than atmospheric by reason of both the centrifugal effect and the additional pressurization.

Figure 3:
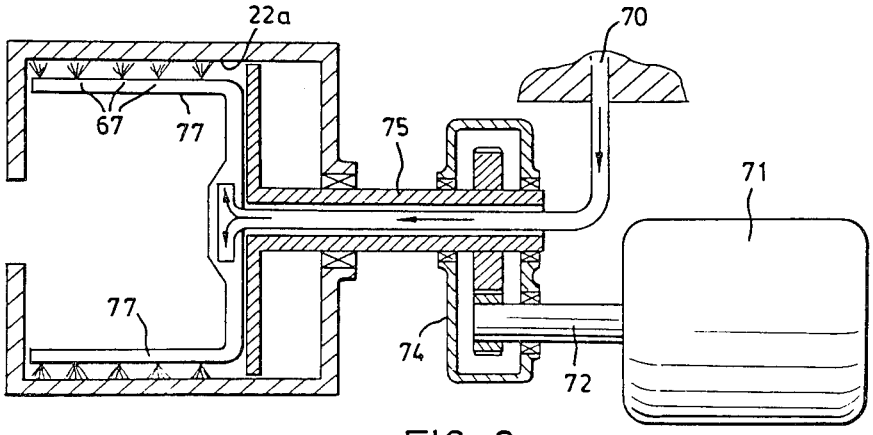
FIG. 3 is a schematic sectional view showing in general the means by which water can be brought to spray orifices adjacent the grinding surface.

While the embodiment shown in FIGS. 1 and 2 is adapted for vertical orientation, i.e. with the axis of rotation extending vertically, the arrangement shown schematically in FIG. 3 is shown in a horizontal orientation. The purpose of FIG. 3 is essentially to show how water can be ducted into a location adjacent the grinding surface **22*a*, and that the centrifuging effect of the rotation of the arms 30 will also produce an increase in the pressure of the water available at nozzles 67**.

By straight-forward mathematical procedures, it is simple to show that, with a radius of 12 inches from the location of the nozzles 67 to the center line of rotation and a rotational rate in the region of 120 radians per second, a pressure increase of the order of 90–100 psi will take place from the center line to the nozzles. This allows the use of relatively low pressure water at the initial feed location 70. Since the pressure varies as the square of the radius and also as the square of the rotational speed, considerable pressure increases for the water can be obtained within quite manageable dimensions.

In FIG. 3, an electric motor 71 rotates the input shaft 72 of a reduction gear box 74, of which the output shaft 75 rotates the hollow arms that are represented in FIG. 3 merely by the water piping 77.

To obtain grinding pressures in the area of 100 psi, which are considered typical of the conventional grinders, mathematical computation shows that, with an 80 inch diameter centrifugal grinder, rotational speeds in the area of 420 rpm are required. This would correspond with a surface speed of about 1760 inches per second.

Attention is now directed to FIGS. 4 through 7, which illustrate the second embodiment of this invention.

Figure 4:
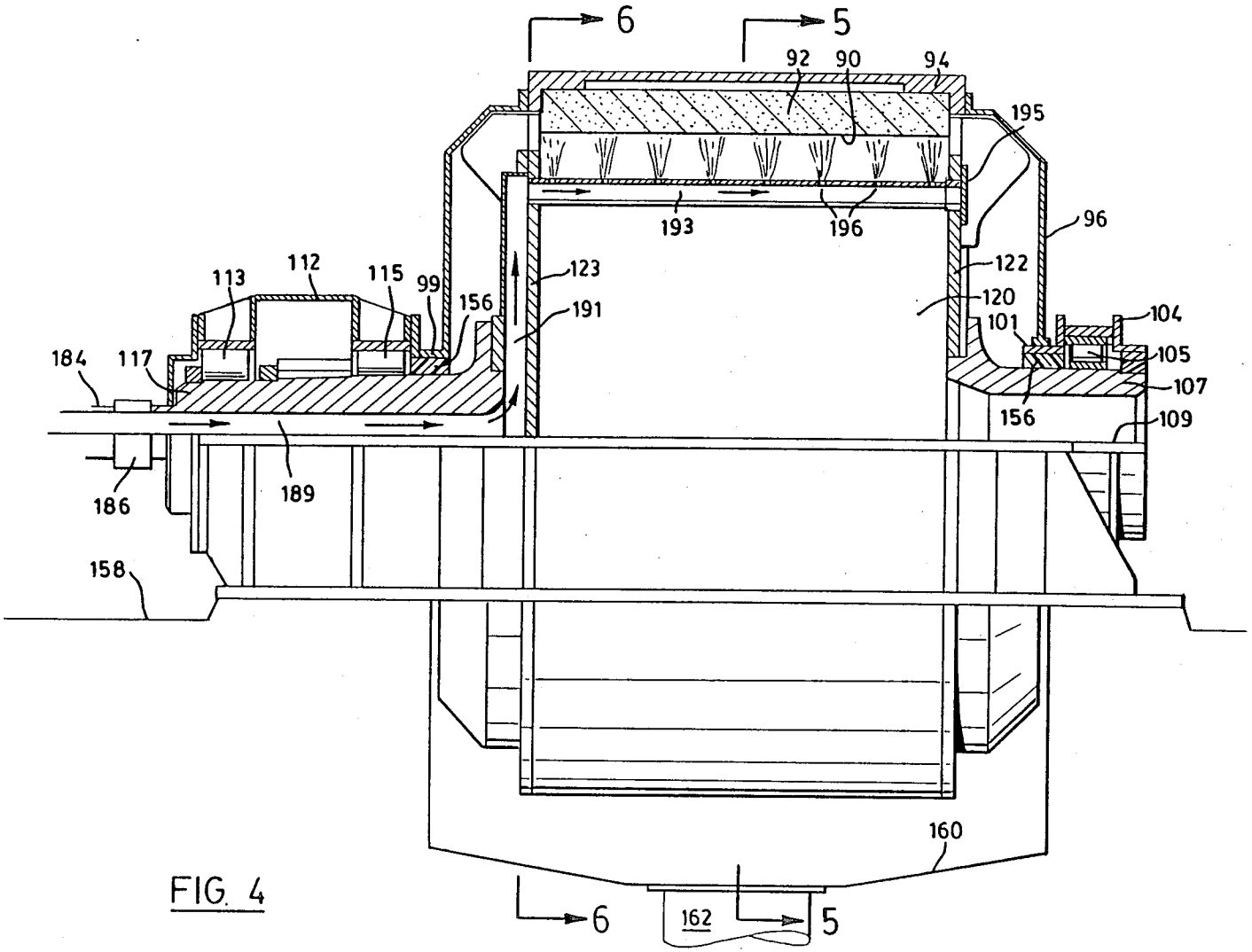
FIG. 4 is an axial sectional view through a second embodiment of this invention.
Figure 5:
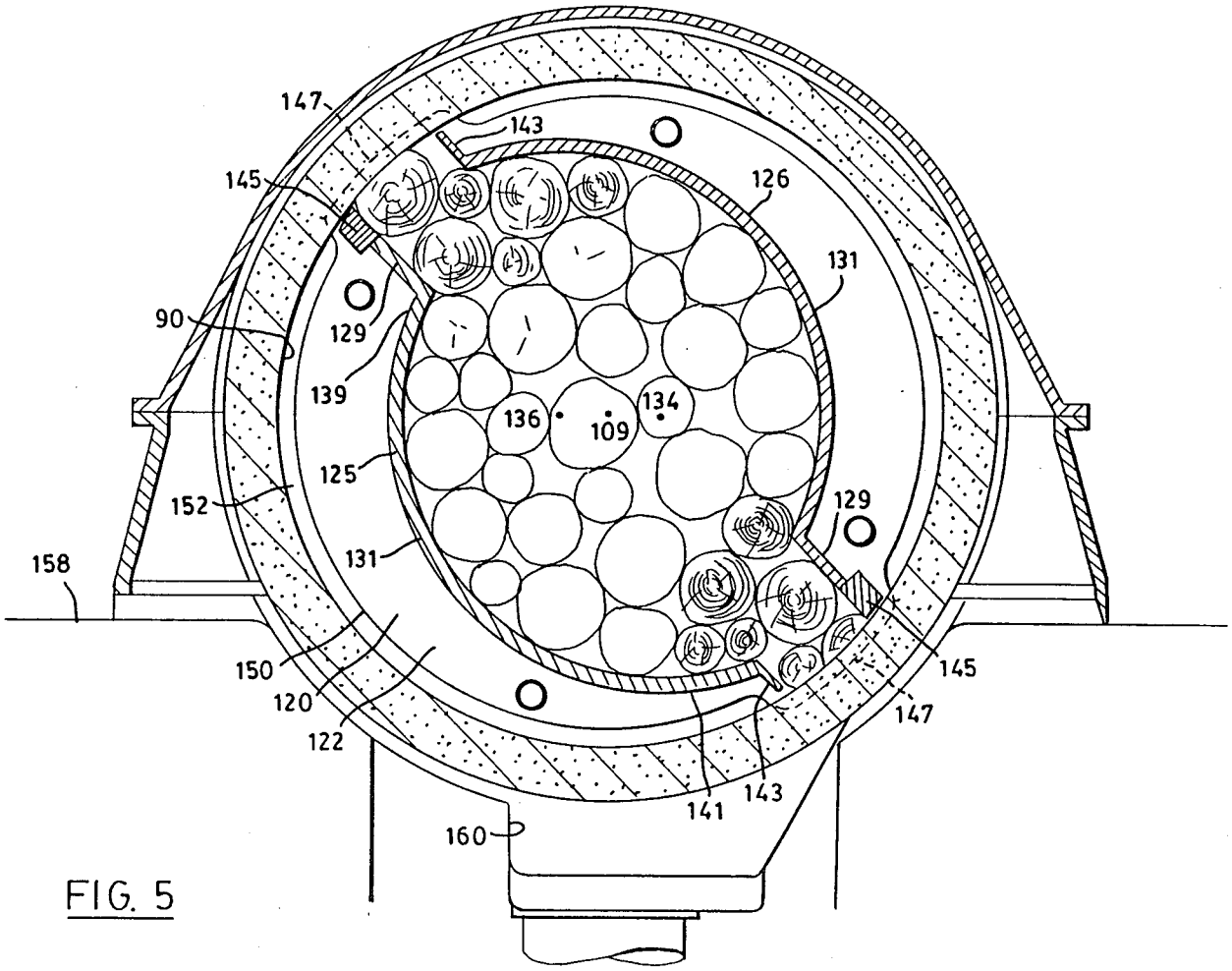
FIG. 5 is a cross-sectional view taken at the line 5—5 in FIG. 4.

In FIGS. 4 and 5, a cylindrical, internal grinding surface 90 is defined by cylindrical sections of suitable stone 92, which are retained in place by a stone retaining frame 94. Connected in a sealed manner with the stone retaining frame 94 is a housing 96, which is sealed at the left in FIG. 4 with respect to a bearing housing 99, and is sealed at the right in FIG. 4 with respect to a bearing housing 101.

The bearing housing 101 at the right in FIG. 4 is connected to a pilot shaft bearing housing 104 containing a series of roller bearing 105 which centrally support a pilot shaft 107 for rotation about a central axis 109.

At the left in FIG. 4, the bearing housing 99 is connected to a drive shaft bearing housing 112 of conventional construction which supports two roller bearings 113 and 115, which centrally support for rotation a low speed drive shaft 117 which, together with the pilot shaft 107, securely supports a rotor 120 for rotation about the axis defined by the line 109.

As best seen by looking together at FIGS. 4 and 5, the rotor 120 consists essentially of two end plates 122 and 123, which support between them two axially extending sickle-shaped members 125 and 126 (see FIG. 5). More specifically, each of the sickle-shaped members 125 and 126 includes an outwardly extending portion 129, and a substantially part-cylindrical portion 131 which is eccentrically located with respect to the axis 109 of the rotor per se. More specifically, looking at FIG. 5, the center of curvature of the leftward part-cylindrical portion 131 is located at 134, while the center of curvature of the rightward part-cylindrical portion 131 is located at 136. The locations of these centers of curvatures are not critical, of course, since the important thing is not where the centers are located, but rather that the surface defined by the portion 131 be such that it is located closer to the actual rotational axis 109 at one of its ends than at the other of its ends. To illustrate, looking at FIG. 5, it can be seen that the region 139 of the part-cylindrical portion 131 adjacent the portion 129 is closer to the axis 109 than the region 141. As can be seen in FIG. 5, the space between the two members 125 and 126 is filled with logs of various diameters. It will be appreciated that as the rotor turns about the axis 109, the centrifugal force thus generated will tend to cause the logs to "run down" the slope of the portion 131, as if this were a downward slope in a gravitational field. In effect, the centrifugal force generated by the rotation of the rotor, provided this is sufficiently fast, will be considerably greater than the gravitational field, so that the logs between the members 125 and 126 will "see" primarily only the centrifugal force as they seek to escape away from the rotational axis 109. As the logs come into contact with the members 125 and 126, since the portions 131 thereof become progressively further and further from the axis 109 in the counter-clockwise direction as pictured in FIG. 5, the logs likewise will tend to roll or move in the counter clockwise direction with respect to members 125 and 126, thus approaching the end regions thereof, where there is a spacing between the members 125 and 126, the spacing being such as to allow the logs to move outward under centrifugal force and contact the inside cylindrical surface 90 of the grinding stone segments. The rotor design shown in FIG. 5 provides a "fluid centre" which avoids a situation developing wherein one pocket is fully loaded while the other one, which may be empty, cannot accept logs because its entrance is blocked.

At the edge of the portions 131 which are the most remote from the axis of rotation 109, there is a guide plate 143 which terminates close to the internal grinding surface 90. At the outer extremity of the portion 129 of each member 125, 126, there is supported a finger bar 145, which serves the purpose of retaining the aqueous slurry constituted by the groundwood stock and the water added thereto, rotating about and against the internal grinding surface 90. Advantageously, the finger bars 145 are shaped to assist in the evacuation of the pulp to the sides of the stone. A suitable configuration for the finger bar at 145 is that described in Canadian Patent No. 947,555, issued May 21, 1974 to Koehring-Waterous Ltd., and invented by G. W. Cryderman.

The outer plates 122 and 123 of the rotor 120 are shaped as illustrated in FIG. 5, the shape being essentially circular but having two outwardly extending antipodal ears 147. The ears 147 are intended to restrict the egress of unwanted slivers. This causes the slivers to remain in the ginding zone and ensures that they are ground out. It will be noted that the nominal outer periphery 150 of the plates 122 and 123 has a smaller diameter than the internal grinding surface 90, thus leaving a gap 152 therebetween, through which pulpwood stock can escape from the internal grinding surface 90. However, the ears 147 extend outwardly beyond the radius of the internal grinding surface 90, and thus overlap the grinding stones segments. This allows the definition of two "grinding cavities" as they might be described, each grinding cavity being defined laterally by two ears 147, outwardly by the grinding surface 90, forwardly by the plate 143 of one of the members 125 and 126, and rearwardly by the portion 129 and finger bar 145 of the other of the members 125 and 126. The logs are flung or urged centrifugally into these grinding cavities, and are there ground into stock.

Returning briefly to FIG. 4, it will be seen that the bearing housings 99 and 101 define the outer limit for two annular stock/oil mechanical seals 156, which bear internally against the low speed drive shaft 117 and the pilot shaft 107 respectively.

Thus, the housing 96 defines the upper portion of a chamber within which the rotor 120 rotates, the chamber retaining the pulpwood stock and directing it downwardly. The lower part of the chamber may, as illustrated in FIGS. 4 and 5, be located below the level of the mill floor 158 in a stock sump 160 provided therein. At the bottom of the stock sump 160 is a stock exit passage way 162, which leads to a further processing step for the stock (this being of no concern to the present invention).

Figure 6:
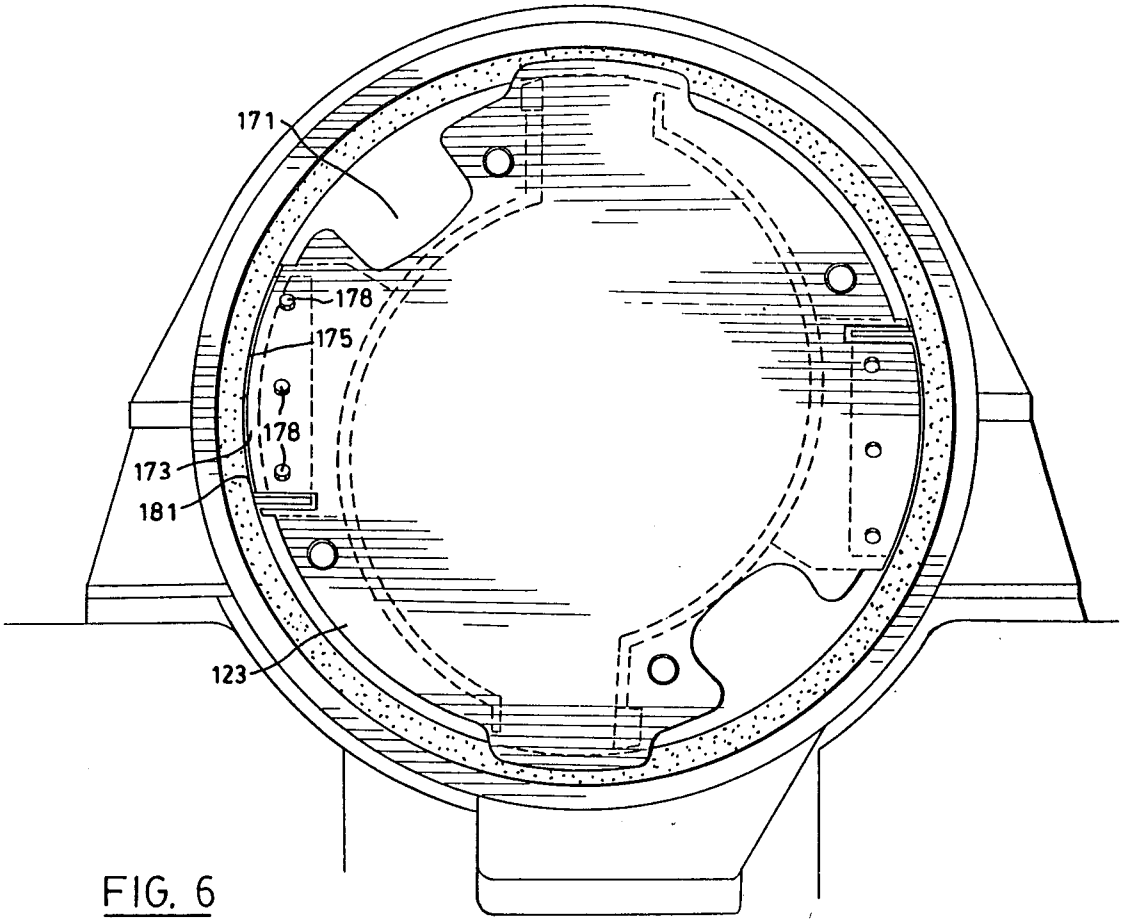
FIG. 6 is a cross-sectional view taken at the line 6—6 in FIG. 4.
Figure 7:
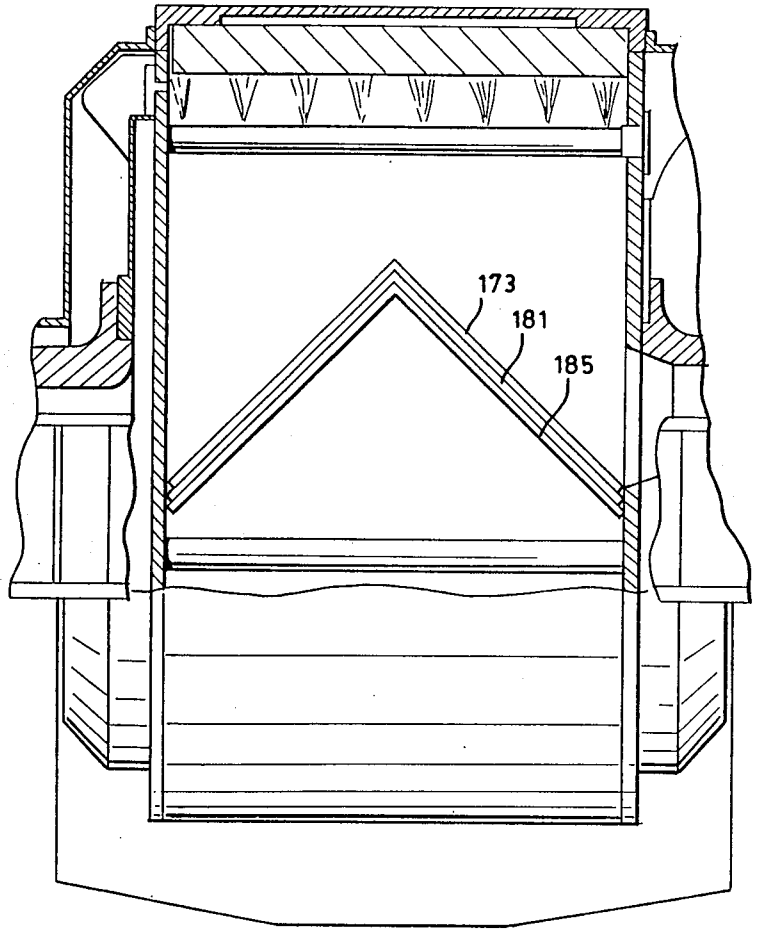
FIG. 7 is an elevational view of the rotor shown in FIG. 6, looking in the direction of the arrow 7.

Attention is now directed to FIGS. 6 and 7, for a description of a particular feature of this invention relating to the desirability of urging the pulpwood stock toward the axial ends of the grinding surface 90, in order to promote removal of the stock from the face of the grinding surface.

FIG. 6 shows an outside end view of the plate 123, being that on the left in FIG. 4. FIG. 6 shows that the leftward plate 123 includes in its periphery a recess 171, but that otherwise the plate 123 has the same shape as the plate 122 shown in FIG. 5. Connected between the two plates 122 and 123 is an inverted V-shaped finger bar holder 173 to which is securely bolted or clamped a secondary finger bar 175, also of inverted V-shape. FIG. 6 shows three fastening assemblies 178, which may be in the form of clamps or bolts.

FIG. 7 shows a direct elevational view of the rotor 120, seen from a direction which shows the secondary finger bar 175 and its holder 173 in true shape. The secondary finger bar 175 consists of two plate elements, each with a curving outside edge 181, having the same curvature as the internal grinding surface 90. Since the direction of rotation seen in FIG. 6 is clockwise (as it is in FIG. 5), which means that the secondary finger bar 175 is moving upwardly as pictured in FIG. 7 during normal rotation of the rotor 120, it will be appreciated that the groundwood stock slurry adhering to the grinding surface 90, but which has escaped beneath the finger bar 145, will be directed in two branches and will be urged axially towards the ends of the internal grinding surface 90, so that it can exit therefrom, and fall down into the stock sump 160.

The secondary finger bar 175 is considered an advantage in that it avoids too great a build-up of groundwood pulp stock on the internal grinding surface 90. Such a build-up could impair the grinding operation.

Attention is again directed to FIGS. 4 and 5 for a description of the water passageways which allow water to enter the grinding chamber axially along the low speed drive shaft 117, and to be made available at a plurality of nozzle locations adjacent the internal grinding surface.

More specifically, looking at FIG. 4, the shower supply water is seen to enter from the left along a feed pipe 184, through a rotary seal 186 and into a central passageway 189 located axially of the low speed drive shaft 117. From the axial passageway 189, a plurality (in this case 4) of radial passageways 191 extend outwardly from and communicate with the passageway 189, the passageways 191 being defined by appropriate pipes or other conduits. At the outer or distal ends of the passageways 123, the latter communicate with respective shower pipes 193 which extend axially with respect to the rotor 120, and which are braced between the plates 122 and 123. As can be seen in FIG. 4, each of the removeable shower pipes 193 is capped at the rightward end with a pipe cap 195, and has a plurality of nozzle openings 196 adjacent the internal grinding surface 90.

As described earlier in this specification, rotation of the rotor 120 increases the pressure in the removeable shower pipes 193, with respect to the pressure in the passageway 189, permitting the supply water entering along the pipe 184 to be less than the intended pressure in the removeable shower pipe 193.

The grinder structure herein disclosed has several advantages, and these are summarized below.

Firstly, the grinding assembly herein disclosed can be used to create pressurized effects but without the need for pressure lock mechanisms.

Secondly, it is expected that this design will allow the grinding of wood chips as well as logs, with the addition of an auger feed or other means of conveyance for the chips.

Further, by feeding the shower water through the rotor, a substantial component of its final pressure can be generated centrifugally. As well, the pressure of the water available at the orifices 196 will increase with the rpm, as will the grinding pressure By comparison with disk refiners, in the chip feed shear area (where chips are accelerated from stationary to rotary motion), the grinder of the present invention rotates more slowly than a refiner. The grinder of the present invention may rotate in the area of 500 rpm, as compared to 1800 rpm for a disk refiner. Thus less power is absorbed than in a refiner (in this specific area), and the chip reaches the working surface of the grinder in better condition due to the lower speed.

While a rotor having two antipodal pockets or grinding cavities has been illustrated in the drawings of this specification, it will be apparent that one, three or more such grinding cavities could be provided.

It will further be understood that the grinding pressure can be controlled accurately by providing means for varying the rotor speed, since this will govern the centrifugal force generated.

Although not illustrated, a screw feed could be utilized to move the logs or woodchips into the center of the rotor through the inlet in the pilot shaft 107. It will be clear that the structure defined in the specification lends itself to continuous loading, a major improvement over the traditional batch loaded grinder. By operating with a continous feed or conveyor system, it is possible with the present apparatus to automate the loading, thus reducing manpower requirements and enhancing safety. These clearly represent advantages by comparison with the traditional type of grinder.

One option that may in the future be added to the design herein disclosed is that of rotating the internal grinding surface in the direction opposite to that of the rotor. This will increase the speed at which the wood traverses the grinding surface, without changing the grinding pressure (which is dependant only upon the centrifugal force, i.e. the speed of rotation of the rotor 120).

A further option would be to utilize a grinding stone surface which is other than cylindrical, for example a conical surface having a profile as shown by the broken line 197 in FIG. 1. This could be used to aid both stock evacuation and rotor-to-stone clearance adjustment. Such an option may well apply to the chip grinding process in particular, where the clearance between the stone and the rotor is more critical, and the variation in peripheral speed due to the varying diameter is of lesser importance.

Because the stone structure is stationary in the present design, the stresses are greatly reduced. The stone design for the present construction consists of vitrified sections set into the steel rim or frame 94. This will permit the provision of a stone having less weight and complexity than traditional structures. A further option is the eventual design of the stone housing so that it forms a jacket for cooling purposes.

While specific embodiments of this invention have been shown in the accompanying drawings and described hereinabove, it will be apparent to those skilled in the art that changes and modifications may be made therein without departing from the essence of this invention, as set forth in the appended claims.

I claim:

1. A centrifugal grinder, comprising:

an internal grinding surface in the shape of a surface of revolution, a rotor mounted for rotation coaxially with said grinding surface, the rotor having a central cavity and defining at least two pockets through which material in the central cavity can contact the grinding surface, the pockets being distributed around the rotor and being separated by intermediate regions, first means for delivering material to be ground to the central cavity, second means for rotating the rotor, and third means incorporated in the rotor for applying water to said grinding surface, said third means including a first water pathway into the rotor adjacent the axis thereof, and for each pocket a second water pathway in the rotor adjacent the grinding surface and trailing the respective pocket in the sense of rotation, a water passage means joining the first pathway to each second pathway, and nozzle means communicating with each second pathway for spraying water against the grinding surface, each second pathway being further than the first pathway from the rotor axis, whereby rotation of the rotor increases the water pressure in the nozzle means with respect to that in the first pathway, due to the centrifugal effect.

2. The invention claimed in claim 1, in which the surface of revolution tapers in one direction along its axis.

3. The invention claimed in claim 2, in which the internal grinding surface is conical.

4. The invention claimed in claim 1, in which the axis of the grinding surface is substantially horizontal.

5. The invention claimed in claim 1, in which the grinding surface is substantially cylindrical.

6. The invention claimed in claim 1, in which there are two said pockets located at antipodal positions on the rotor, the intermediate regions being of greater circumferential extent than each pocket.

7. The invention claimed in claim 6, in which each nozzle means comprises a plurality of nozzles for spraying water against the grinding surface.

8. The invention claimed in claim 1 or claim 7, in which a primary finger bar is provided on the rotor behind each pocket and ahead of the corresponding second water pathway in the direction of rotation, the primary finger bar running substantially parallel with the rotor axis, and in which a secondary finger bar is provided on the rotor behind each primary finger bar in the direction of rotation, each secondary finger bar being herringbone in configuration with the apex leading, so that the effect of the secondary finger bar is to urge pulpwood stock toward the axial ends of the grinding surface.

9. The invention claimed in claim 1 or claim 7, in which a primary finger bar is provided on the rotor behind each pocket and ahead of the corresponding second water pathway in the direction of rotation, the primary finger bar running substantially parallel with the rotor axis, and in which a secondary finger bar is provided on the rotor behind each primary finger bar in the direction of rotation, each secondary finger bar being herringbone in configuration with the apex leading, so that the effect of the secondary finger bar is to urge pulpwood stock toward the axial ends of the grinding surface, the grinder further including a housing defining a stock evacuation chamber at both ends of the grinding surface, and a stock outlet communicating with said stock evacuation chambers.

10. The invention claimed in claim 1, in which the first water pathway is coaxial with the rotor.

* * * * *